United States Patent [19]

Nara et al.

[11] 4,402,655

[45] Sep. 6, 1983

[54] VANE PUMP WITH SYMMETRICAL INCLINED FLUID CONFINEMENT INITIATING LINE

[75] Inventors: Akio Nara; Hideaki Sasaya, both of Okazaki; Shigeru Takagi, Anjo; Takao Mitsui, Aichi, all of Japan

[73] Assignee: Nippon Soken, Inc., Nishio, Japan

[21] Appl. No.: 172,195

[22] Filed: Jul. 25, 1980

[30] Foreign Application Priority Data

Jul. 30, 1979 [JP] Japan ..... 54-96984

[51] Int. Cl.[3] ..... F04C 18/00; F04C 29/00

[52] U.S. Cl. ..... 418/137; 418/241

[58] Field of Search ..... 418/15, 137, 138, 241

[56] References Cited

U.S. PATENT DOCUMENTS

| | | | |
|---|---|---|---|
| 2,924,178 | 2/1960 | Hogan | 418/15 |
| 3,083,646 | 4/1963 | Weiss | 418/241 |
| 3,343,782 | 9/1967 | Brewer et al. | 418/137 |
| 3,844,696 | 10/1974 | Stiles et al. | 418/137 |

FOREIGN PATENT DOCUMENTS

| | | | |
|---|---|---|---|
| 2254185 | 5/1974 | Fed. Rep. of Germany | 418/15 |
| 375789 | 6/1932 | United Kingdom | 418/241 |

*Primary Examiner*—John J. Vrablik

*Attorney, Agent, or Firm*—Cushman, Darby & Cushman

[57] ABSTRACT

A vane type pump having a housing formed with an inlet chamber and an outlet chamber and having a cylinder portion, a cylindrical rotor mounted for eccentric rotation in the cylinder portion, and a plurality of vane mounted for concentric rotation in the cylinder portion. The rotor is formed with slots through which the vanes extend into a space defined between the inner peripheral wall of the cylinder portion and the outer peripheral wall of the rotor so as to divide the space to define a working chamber variable in volume for pumping effect. The inlet chamber is associated with the cylinder portion to define a fluid confinement initiating line at which the working chamber begins to be isolated from the inlet chamber when the forward end of one of the vanes passes the line. The fluid confinement initiating line is in a symmetrical inclined configuration such that the line is generally symmetrical with respect to the widthwise center line of the cylinder portion and is inclined with respect to the longitudinal axis of the cylinder portion over the substantially entire length of the line beginning at opposite ends of the cylinder portion.

9 Claims, 9 Drawing Figures

VANE PUMP WITH SYMMETRICAL INCLINED FLUID CONFINEMENT INITIATING LINE

BACKGROUND OF THE INVENTION

This invention relates to vane type air pumps, and more particularly it deals with a vane type air pump suitable for use in injecting secondary air into engine exhaust passages for additional burning of the exhaust gases emitted from the engine combustion chambers to reduce the proportion of unburned exhaust gas constituents.

In one type of air pump known in the art, vane members are mounted for rotation through needle bearings on a pivot shaft in loose fitting, so that the vane members can move axially relatively easily. In this construction, when axially directed loads are produced in the vane members, the vane members would be moved by such loads and the contact pressure between the vane members and side seal members would increase, thereby causing great wear on the side seal members. In the initial stages of development of such wear, gaps between the side seal members and vane members would increase in size and cause a reduction in the flow rate of air supplied by the pump. A further increase in the wear of the seal members would result in the vane members coming into contact with one end of a cylinder portion of the housing. When this situation is brought about, the vane members would strike and end of the cylinder portion and make a noise as they rotate, in addition to the reduction in the flow rate of air delivered by the pump. The noise makes the user feel unpleasant because it is generated by metal-to-metal contact.

SUMMARY OF THE INVENTION

For the purpose of developing an air pump free from the aforesaid disadvantages of the prior art, we have conducted research into the cause responsible for the development of axially directed loads in the vane members. The research has revealed the following two facts: one is that the vane members begin to shift axially as they start confiming of the air in a working chamber after they have passed the inlet chamber of the cylinder portion, and the other is that the pressure differential between the opposite ends of the vane members begins to increase in the vicinity of the same rotational angle.

It has been ascertained that these phenomenons can be attributed to the shape and configuration of the inlet chamber of the cylinder portion. In detail, in this type of air pump, confining of the air in the working chamber is initiated as the vane members rotate. However, in order to suppress noise which would be produced by sudden confining of the fluid, an air confinement initiating line defined by the inlet chamber is oblique with respect to the vane members (See FIG. 1). Because of this, confining of the air is effected from one end of each vane member and pressure differential is produced between the opposite ends of the vane members, thereby producing a thrust which is oriented from the direction in which confinement is first effected in the direction in which confinement is the air is delayed. Thus a smooth and quiet operation of the pump is made impossible.

This invention has been developed based on the results of the research referred to hereinabove.

An object of the invention is to provide a vane type pump which can reduce wear on the side seal members while avoiding sudden confinement of a fluid in the working chamber, thereby reducing noise and ensuring a smooth and quiet operation of the pump.

According to the present invention, there is provided a vane type pump comprising a housing formed with an inlet chamber and outlet chamber and having a cylinder portion, a cylindrical rotor mounted for eccentric rotation in said cylinder portion, and a plurality of vanes mounted for concentric rotation in said cylinder portion, said rotor being formed with slots through which said vanes extend into a space defined between the inner peripheral wall of said cylinder portion and the outer peripheral wall of said rotor so as to devide said space to define a working chamber variable in volume for pumping effect, said inlet chamber being associated with said cylinder portion to define a fluid confinement initiating line at which said working chamber begins to be isolated from said inlet chamber so as to initiate confining of a fluid in said working chamber when the forward end of one of said vanes passes said line, said fluid confinement initiating line being in a symmetrical inclined configuration such that said line is generally symmetrical with respect to the widthwise center line of said cylinder portion and is inclined with respect to the longitudinal axis of said cylinder portion over the substantially entire length of said line beginning at opposite ends of said cylinder portion.

The confinement initiating line desirably also is so shaped that the rate of change of the area of the opening defined by such line and the forward end of one of the ends moving along the line decreases as the vane approaches completion of closing of the opening. Thus, the abrupt or sudden confinement of air in the working chamber is reduced with consequent further noise reduction.

In a preferred embodiment, said fluid confinement initiating line includes a protruding configuration in which the line protrudes away from said inlet chamber so as to provide the greatest distance therefrom at the center of the longitudinal axis of said cylinder portion.

In another preferred embodiment, said fluid confinement initiating line may include a protruding configuration in which the line protrudes toward said inlet chamber so as to provide the closest distance therefrom at the center of the longitudinal axis of said cylinder portion.

Said fluid confinement initiating line may includes at least one smooth curve or straight lines.

In still another preferred embodiment, a plurality of circumferential grooves may be formed in the wall of said inlet chamber to provide cut lines associated with said cylinder portion, and said fluid confinement initiating line may include said cut lines.

DESCRIPTION OF THE PREFERRED EMBODIMENTS

Figure 1:
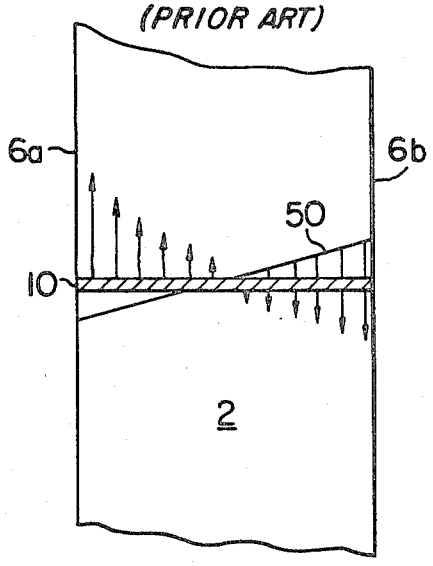
FIG. 1 (PRIOR ART)
FIG. 1 is a schematic view in explanation of the manner in which air is confined in the working chamber of an air pump of the prior art.
Figure 2:
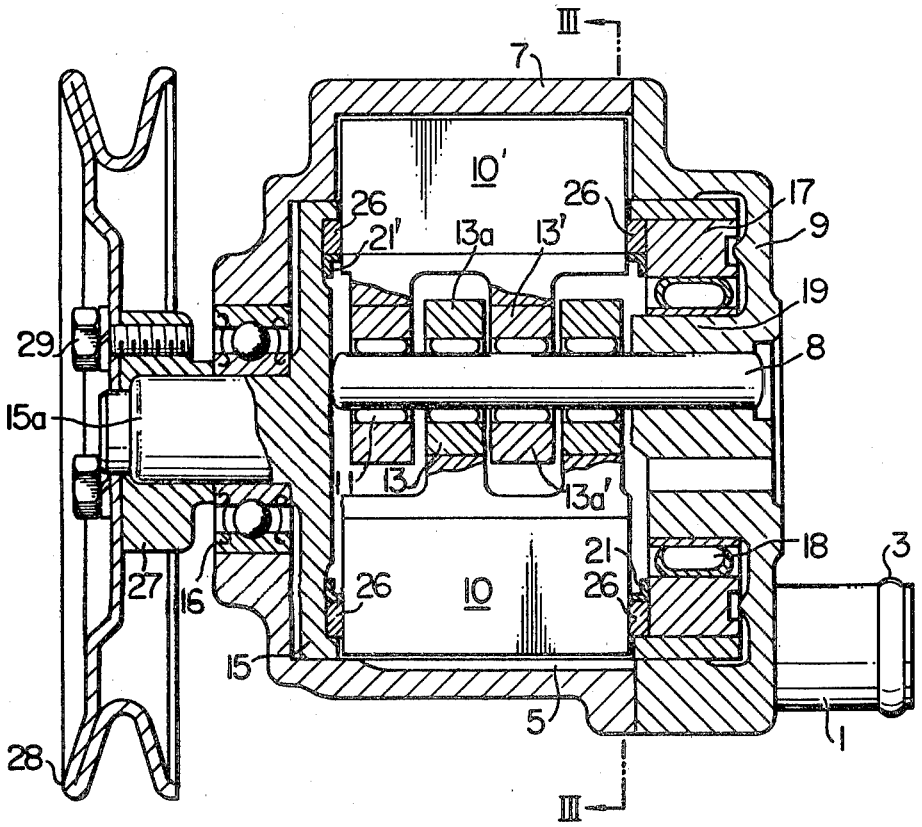
FIG. 2 is a sectional view of the air pump comprising one embodiment of the invention.

One embodiment of the invention will now be described by referring to FIGS. 2, 3, 4 and 5.

A fluid suction line 1 is connected to an inlet chamber 2, and a fluid discharging line 3 is connected to an outlet chamber 4. The inlet chamber 2 and the outlet chamber 4 are separated from each other by a land 5 and formed in a housing 7 having a cylinder portion 6. A pivot shaft 8 is force fitted and secured in an opening formed in the center of an end plate 9. A plurality of vanes 10 and 10′ are loosely fitted over the pivot shaft 8 for rotation through connectors 13 and 13′ and needle bearings 11. Portions of the connectors 13 and 13′ located opposite the vanes 10 and 10′ with respect to the pivot shaft 8 constitute balance weights 13*a* and 13*a*′ respectively to maintain balance when the vanes 10 and 10′ rotate.

A rotor 15 is journalled at its forward portion by the housing 7 through a ball bearing 16 and has a ring 17 force fitted in an annular recess formed in the rearward portion of the rotor 15. The ring 17 has a needle bearing 18 force fitted therein and maintained in rolling engagement at its inner side with a bearing portion 19 formed in the end plate 9. Thus the rotor 15 is rotatably journalled by the bearings 16 and 18. The rotor 15 is formed with slots 20 and 20′ in positions dimetrically opposite to each other and has shoe plates 21 and 21′ attached to the inner peripheral wall thereof adjacent the slots 20 and 20′ respectively. The shoe plates 21 and 21′ have inserted between the shoe plates 21 and 21′ and the inner peripheral wall of the rotor 15 shoes 22 and 23 which press against the vanes 10 and 10′ by a suitable biasing force exerted by shoe springs 24 and shoe plates 25, to avoid leakage of the fluid through the slots 20 and 20′.

The vanes 10 and 10′ extending through the slots 20 and 20′ formed in the rotor 15 are axially positioned both at the forward end and the rearward end by four side shoes 26 arranged in the shoe plates 21 and 21′. The vanes 10 and 10′ are in contact with the side shoes 26 to provide a side seal. The vanes 10 and 10′ are essentially out of contact with the inner peripheral wall of the cylinder portion 6, so that the air pump can be operated at high speed without requiring lubrication.

The rotor 15 has a forward shaft portion 15*a* having a hub 27 force fitted over it, the hub 27 having a pulley 28 bolted thereto at 29 to enable the rotor 15 to rotate eccentrically in the cylinder 6. The outer peripheral wall of the rotor 15, the inner peripheral wall of the cylinder portion and the vanes 10 and 10′ define a working chamber which undergoes changes in volume to compress the air sucked thereinto and discharge same.

The inlet chamber 2 is associated with the cylinder portion 6 to define an air confinement initiating line 50. When the forward end of one of the vanes 10 and 10′ passes the line 50, the working chamber commences to be isolated from the inlet chamber 2 to initiate confining of the air in the working chamber. Stated differently, the working chamber begins to be reduced in volume. The outlet chamber 4 is associated with the cylinder portion 6 to define an air discharging initiating line 60. When the forward end of one of the vanes 10 and 10′ passes the line 60, discharging of the compressed air from the working chamber of reduced volume is initiated.

In the vane type air pump according to the invention, the air confinement initiating line 50 has a symmetrical inclined configuration such that the line is generally symmetrical with respect to the widthwise center line of the cylinder portion 6 and is inclined with respect to the longitudinal axis of the cylinder portion 6 over the substantially entire length of the line 50 beginning at the opposite ends 6*a* and 6*b* of the cylinder portion 6. By this arrangement, the position in which confining of the air in the working chamber is initiated is symmetrical with respect to the center of the cylinder portion 6 and the air confinement initiating line 50 is inclined with respect to the forward end of each of the vanes 10 and 10′ at any point in time at which confining of the air is initiated, progresses and is terminated. In the embodiment shown in FIG. 4, the air confinement initiating line 50 has a protruding configuration in which the line 50 protrudes away from the inlet chamber 2 so as to provide the greatest distance from the inlet chamber 2 at the center of the longitudinal axis of the cylinder portion 6.

Figure 3:
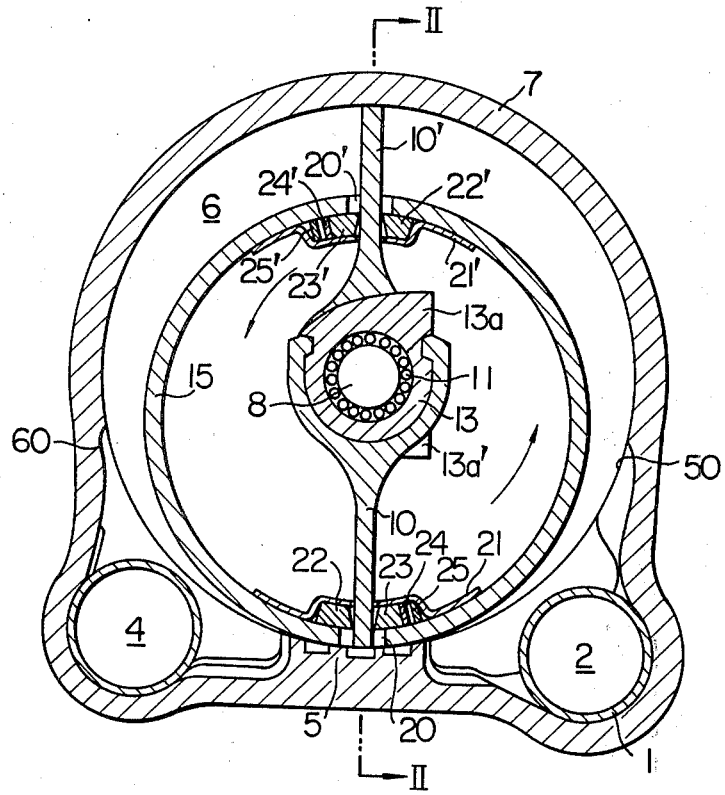
FIG. 3 is a sectional view taken along the line III—III in FIG. 2.

Operation of the vane type air pump of the aforesaid construction will be described. Motive force is transmitted from a power source, not shown, via a V-belt to the pulley 28 bolted at 29 to the hub 27 so that rotation of the pulley 28 drives the rotor 15 which rotates about the pivot shaft 8 with the vanes 10 and 10′ being held in the slits 20 and 20′ respectively, and moves in vertical movement relative to the vanes 10 and 10′ while rotating. In FIG. 3, the rotor 15 rotates counterclockwise, and when the vane 10 passes the land 5 suction of the air is commenced. The amount of the sucked air is maximized immediately before the vane 10 reaches the air confinement initiating line 50 at which the working chamber begins to be isolated from the inlet chamber 2.

Figure 4:
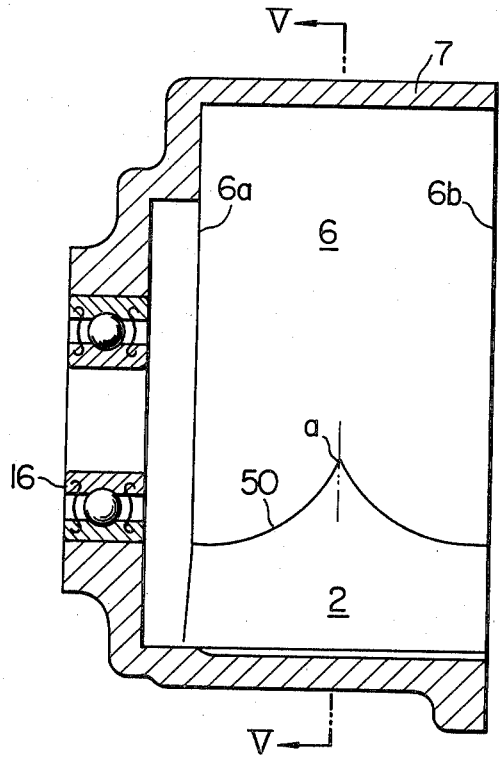
FIG. 4 is a sectional view of showing the housing of the pump shown in FIG. 2.
Figure 5:
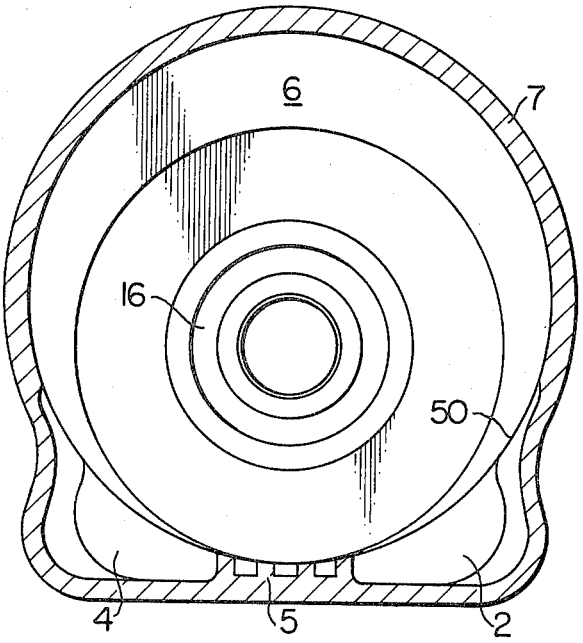
FIG. 5 is a sectional view taken along the line V—V in FIG. 4.

In the embodiment shown in FIG. 4, the air confinement initiating line 50 is inclined such that the line begins to tilt at the opposite ends 6*a* and 6*b* of the cylinder 6 with respect to the longitudinal axis of the cylinder portion 6 and is symmetrical with respect to the widthwise center line of the cylinder portion 6. Accordingly, confining of the air is simultaneously initiated smoothly at the opposite ends of the vane 10 and gradually progresses proportionally. As the vane 10 reaches a center point a shown in FIG. 4, the working chamber is isolated from the inlet chamber 2. At the same time, the vane 10′ reaches the air discharging initiating line 60 defined by the outlet chamber 4 so that exhausting of the air confined in the working chamber is initiated.

As described hereinabove, at the end of the suction stroke of the air pump, confining of the sucked air takes place symmetrically with each vane. Thus pressure differential is difficult to develop at the opposite ends of each vane and consequently production of a load tending to shift the vanes axially can be avoided.

Figure 6:
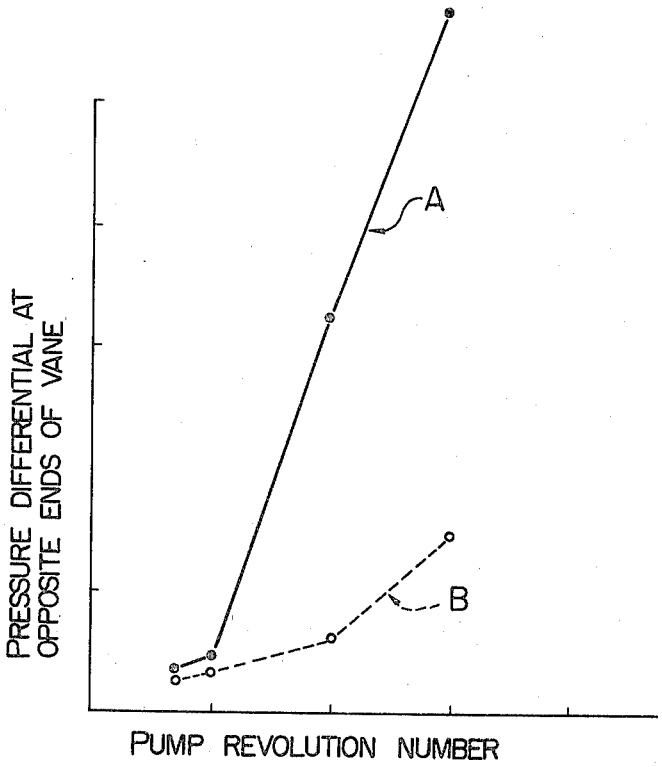
FIG. 6 is a graph showing the pressure differential between opposite ends of the vanes of an air pump of the prior art and the air pump according to the invention.

FIG. 6 is a diagram showing the effect achieved by the invention, wherein the ordinate represents the pressure differential at the opposite ends of each vane and the abscissa indicates the number of revolutions of the pump. Tests were conducted under the same condition of the delivery pressure of 0.6 kg/cm$^2$. A solid line A represents the pressure differential produced in an air pump of the prior art having an air confinement initiating line of a straight line configuration which is inclined such that the vane first confines an air along the front portion of the line on the pulley side and then confines the air along the rear portion of the line. It will be seen that in the air pump of the prior art the pressure differential at the opposite ends of each vane suddenly increases as the number of revolutions increases. A broken line B represents the pressure differential produced in the air pump according to the invention. It will be noted that according to the invention there is very little increase in pressure differential even if the number of revolutions increases.

Figure 9:
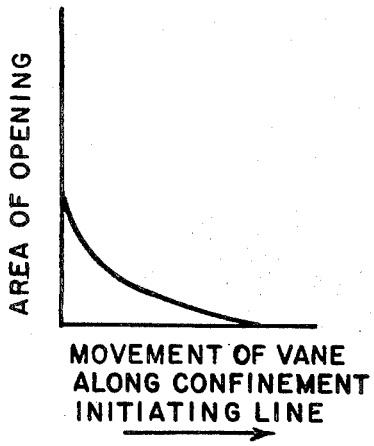
FIG. 9 is a graph showing the rate of change of the area of the opening defined by a confinement initiating line embodying this invention and one of the vanes moving along such line.

It will be also noted that according to the invention, the air confinement initiating line is inclined with respect to the longitudinal axis of the cylinder portion 6 over the substantially entire length of the line 50 beginning at the opposite ends 6*a* and 6*b* of the cylinder portion 6. It also will be noted that the confinement initiating line 50 is curved and has a gradient which gradually becomes steeper as the line approaches the point where the opening between the line and the vane moving therealong is closed. The result is that the rate of change of the area of the opening defined by such line and the forward end of one of the vanes 10 moving along the line decreases as the vane approaches completion of the closing of the opening. This effect is illustrated by the graph shown in FIG. 9 wherein it will be seen that the rate of change of the area of such opening decreases as a vane moves along the confinement initiating line. Thus, confining of the air is initiated smoothly at the opposite ends of each vane and gradually progresses, for example, toward the center point a shown in FIG. 4, so that no sudden confining of the air occurs at any point in time of air confining initiation, air confining progress and air confining termination. This is conductive to elimination of noise which would otherwise be produced by such sudden confining of the air.

The embodiment shown in FIG. 4 is a preferred embodiment, but it is to be understood that the invention is not limited to this specific form of the embodiment.

Figure 7:
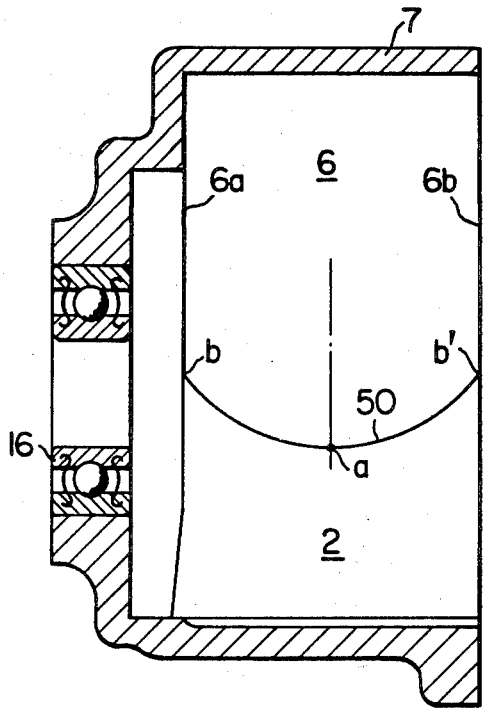
FIGS. 7 and 8 are sectional views showing other embodiments of the invention.

FIG. 7 shows another embodiment in which, as in the embodiment shown in FIG. 4, the air confinement initiating line 50 is symmetrical with respect to the widthwise center line of the cylinder portion 6 and is inclined with respect to the longitudinal axis of the cylinder portion 6 over the substantially entire length of the line 50 beginning at the opposite ends 6*a* and 6*b* of the cylinder portion 6, but the air confinement initiating line 50 has a protruding configuration in which the line 50 protrudes toward the inlet chamber 2 so as to provide the closest distance from the outlet chamber 2 at the center point a of the longitudinal axis of the cylinder portion 6. That is, in this embodiment too, the air confinement initiating line 50 is inclined near the center point a with respect to the longitudinal axis of the cylinder portion 6. Thus it will be noted that in this embodiment, confining of the air is smoothly initiated at the center point a of each vane 10 (10') and the cylinder portion 6, and smoothly terminated at opposite ends b and b' thereof.

In the embodiment shown in FIG. 7, the air confinement initiating line 50 may consist of straight lines joined at the center point a and inclined toward the opposite ends 6*a* and 6*b* of the cylinder portion 6, instead of being curved as shown. This alternative can achieve the same effects regardless of the variations in the form of the air confinement initiating line.

Figure 8:
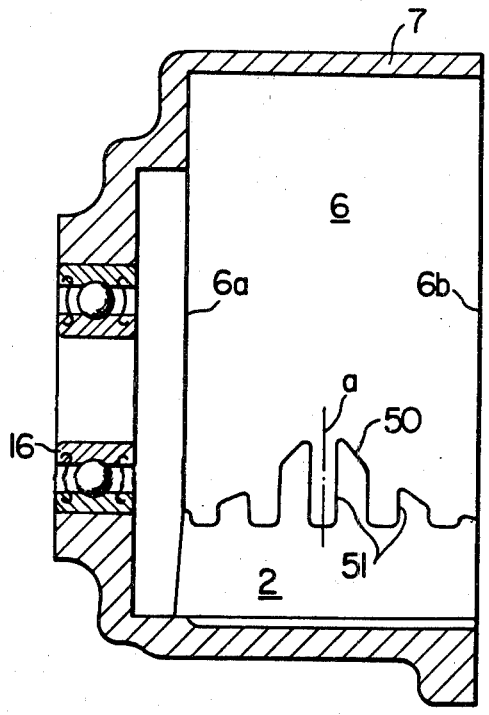

In the embodiments shown and described hereinabove, a plurality of circumferential grooves 51 may be formed, as shown in FIG. 8, in the wall of the inlet chamber 2 in such a manner that the grooves 51 are symmetrical with respect to the widthwise center line of the cylinder 6, so that the air confinement initiating line may include cut lines formed by the grooves 51. It will be noted that by the specific form of the air confinement initiating line 51 shown in FIG. 8, sudden confining of the air can be more effectively avoided by the grooves 51, enabling the pump to operate more smoothly and quietly.

From the foregoing description, it will be appreciated that according to the invention the air confinement initiating line of the air pump is symmetrical with respect to the widthwise center line of the cylinder portion. Thus confining of the air into the working chamber can be effected symmetrically with respect to the forward end of each vane, so that pressure differential difficult to develop at the opposite ends of each vane and consequently the load urging the vane to move toward the side of the cylinder portion is difficult to develop. This is conducive to a marked reduction in the wear which would otherwise be caused to the side of the cylinder portion.

Also, the air confinement initiating line of the air pump according to the invention is inclined with respect to the longitudinal axis of the cylinder portion over the substantially entire length of the line beginning at the opposite ends of the cylinder portion. This feature contributes to an avoidance of sudden confinement of the air at any point in time including initiation of air confining, progress of air confining and termination of air confining. Thus, the present invention can reduce noise and ensure a smooth and quiet operation of the pump.

What is claimed is:

1. A vane type pump comprising a housing formed with an inlet chamber and an outlet chamber and having a cylinder portion, a cylindrical rotor mounted for eccentric rotation in said cylinder portion, and a plurality of vanes mounted for concentric rotation in said cylinder portion, said rotor being formed with slots through which said vanes extend into a space defined between the inner peripheral wall of said cylinder portion and the outer peripheral wall of said rotor so as to divide said space to define a working chamber variable in volume for pumping effect, said inlet chamber being associated with said cylinder portion to define a fluid confinement initiating line at which said working chamber begins to be isolated from said inlet chamber so as to initiate confining of a fluid in said working chamber when the forward end of one of said vanes passes said line, said fluid confinement initiating line being in a symmetrical configuration such that said line is generally symmetrical with respect to the widthwise center line of said cylinder portion and at least portions of said line are inclined with respect to the longitudinal axis of said cylinder portion beginning at opposite ends of said cylinder portion, and said fluid confinement initiating line being shaped such that the rate of change in the area of an opening defined by the fluid confinement initiating line and the forward end of one of said vanes moving therealong becomes smaller as said one vane approaches completion of closing of said opening.

2. A vane type pump as claimed in claim 1, wherein the fluid confinement initiating line comprises a line curved to show a gradient which gradually becomes steeper as the line approaches the widthwise center line of the cylinder portion.

3. A vane type pump as claimed in claim 1, wherein the fluid confinement initiating line comprises a line curved to show a gradient which gradually becomes steeper as the line approaches the axial opposed ends of the cylinder portion.

4. A vane type pump as claimed in claim 1, wherein said fluid confinement initiating line includes a protruding configuration in which the line protrudes away from said inlet chamber so as to provide the greatest distance therefrom at the center of the longitudinal axis of said cylinder portion.

5. A vane type pump as claimed in claim 1, wherein said fluid confinement initiating line includes a protruding configuration in which the line protrudes toward said inlet chamber so as to provide the closest distance therefrom at the center of the longitudinal axis of said cylinder portion.

6. A vane type pump as claimed in claim 4 or 5, wherein said fluid confinement initiating line includes at least one smooth curve.

7. A vane type pump as claimed in claim 4 or 5, wherein said fluid confinement initiating line includes straight lines.

8. A vane type pump as claimed in claim 1, wherein the fluid confinement initiating line comprises a plurality of circumferentially oriented grooves in the wall of the inlet chamber.

9. A vane type pump as claimed in claim 8, wherein said grooves include bottom ends which are positioned on a line curved to show a gradient which gradually becomes steeper as the line approaches the widthwise center line of the cylinder portion.

* * * * *